US006781557B1

(12) United States Patent
Ueoka et al.

(10) Patent No.: US 6,781,557 B1
(45) Date of Patent: Aug. 24, 2004

(54) ANTENNA FORMED FROM A PLURALITY OF STACKED BASES

(75) Inventors: Yasushige Ueoka, Omiya (JP); Takao Yokoshima, Omiya (JP); Shiro Sugimura, Kanazawa (JP)

(73) Assignees: Mitsubishi Materials, Tokyo (JP); FEC Corporation, Kanasawa (JP)

( * ) Notice: Subject to any disclaimer, the term of this patent is extended or adjusted under 35 U.S.C. 154(b) by 0 days.

(21) Appl. No.: 09/698,053

(22) Filed: Oct. 30, 2000

(30) Foreign Application Priority Data

Oct. 29, 1999 (JP) ..... 11-310352
Aug. 29, 2000 (JP) ..... 2000-259878

(51) Int. Cl.[7] ..... H01Q 1/38
(52) U.S. Cl. ..... 343/873; 343/895
(58) Field of Search ..... 343/700 MS, 795, 343/895, 873; H01Q 1/38

(56) References Cited

U.S. PATENT DOCUMENTS 5,898,403 A * 4/1999 Saitoh et al. ..... 343/700 MS
6,075,491 A * 6/2000 Dakeya et al. ..... 343/722
6,597,315 B2 * 7/2003 Yokoshima et al. . 343/700 MS
6,600,459 B2 * 7/2003 Yokoshima et al. ..... 343/895
6,642,904 B2 * 11/2003 Yokoshima et al. ..... 343/829
6,680,713 B2 * 1/2004 Yokoshima et al. ..... 343/895

* cited by examiner

*Primary Examiner*—Michael C. Wimer
(74) *Attorney, Agent, or Firm*—Oblon, Spivak, McClelland, Maier & Neustadt, P.C.

(57) ABSTRACT

An antenna includes a plurality of bases stacked in a thickness direction, conductor patterns formed on the bases, respectively, and conducting sections for electrically interconnecting the conductor patterns. The conductor patterns form inductance components and capacitance components.

24 Claims, 2 Drawing Sheets

ANTENNA FORMED FROM A PLURALITY OF STACKED BASES

CROSS-REFERENCE TO RELATED APPLICATIONS

The present document is related to and claims priority on Japanese priority documents JP11-310352 and JP 2000-259878 filed in the Japanese Patent Office on Oct. 24, 1999, and Aug. 29, 2000, respectively, the entire contents of which are hereby incorporated herein by reference.

BACKGROUND OF THE INVENTION

1. Field of the Invention

The present invention relates to antennas incorporated into various apparatuses, such as various communication apparatuses for transmitting and receiving radio waves, which have functions of transmitting and receiving radio waves.

2. Description of the Related Art

Recently, various apparatuses, such as communications apparatuses for transmitting and receiving radio waves, which have functions of transmitting and receiving radio waves in a broad sense, are in increasing demand. Accordingly, an increasing number of antennas used within a frequency band from a few hundreds of MHz to a few GHz have been employed. These antennas are used in, for example, mobile communication, next-generation transportation systems, and non-contact cards used in automatic ticket readers. Methods for performing wireless data communication without using long, burdensome cables have been introduced, including wireless communication between cordless Internet appliances, wireless local area networks (LAN), and for Bluetooth. The above antennas are expected to be widely used in these fields. Such antennas are also used in wireless data transmission and reception from various terminals. The demand for antennas is increasing in the fields of telemetering for communicating safety management information concerning waterworks and gas systems by radio waves, point-of-sale (POS) systems for banking terminals, and the like. Moreover, such antennas are applicable to home appliances including televisions, such as portable satellite broadcasting receivers, and for automatic vending machines. The range of uses of such antennas is very broad.

As antennas for use in apparatuses having functions of transmitting and receiving radio waves, retractable monopole antennas, which are mounted on casings of apparatuses, are mainly used. In addition, helical antennas, which slightly protrude to the outside of the casings, are known.

The background antennas, such as monopole antennas, are disadvantageous in that it is burdensome to handle monopole antennas and in that monopole antennas are easily damaged since they are required to be extended during used. Helical antennas are disadvantageous in that, since antenna elements formed of air core coils are protected by covering materials such as a resin, the outer dimensions tend to be greater. When helical antennas are fixed so that they protrude from casings, the overall appearance is not satisfactory.

SUMMARY OF THE INVENTION

In order to address the above mentioned and other problems, it is an object of the present invention to provide a small antenna to be attached to the interior of a casing of various types of apparatuses, including various communication apparatuses for transmitting and receiving radio waves, which have functions of transmitting and receiving radio waves, so that it is not necessary to extend the antenna, so that the antenna is not easily damaged, and so that the overall appearance of the apparatuses is not worsened.

According to an aspect of the present invention, an antenna is provided including a plurality of bases stacked in the thickness direction. Conductor patterns are formed on the bases, and conducting sections for electrically interconnecting the conductor patterns are formed on the bases. The conductor patterns form inductance components and capacitance components.

With such a configuration, a resonant system required to transmit and receive radio waves is configured with the inductance components and the capacitance components, and hence the resonant system functions as an antenna.

Among the conductor patterns formed on the bases, a capacitance component may be constructed of a conductor pattern formed on a first base and a conductor pattern formed on a second base. An inductance component may be constructed of at least one of those two conductor patterns. The capacitance component and the inductance component may be connected in parallel.

With such a configuration, the capacitance component and the inductance component formed of the conductor patterns are connected in parallel to form the resonant system required to transmit and receive radio waves, which functions as the antenna.

The conductor patterns may include capacitance patterns and inductance patterns. Among the bases, an inductance pattern may be formed on a first base. A first capacitance pattern may be formed on a second base adjoining the first base. A second capacitance pattern, which is opposed to the first capacitance pattern to form a capacitance component, may be formed on a third base adjoining the second base. The inductance pattern and the capacitance component formed by the first and the second capacitance patterns may be connected in parallel by the connecting section.

With such an arrangement, the capacitance component and the inductance component formed of the conductor patterns are connected in parallel to form the resonant system required to transmit and receive radio waves, which functions as the antenna.

On a surface of the outermost base among the bases, a shielding conductor pattern may be formed so as to be exposed to the outside. In plan view, the shielding conductor pattern may be disposed on the conductor patterns formed on other of the bases.

With such an arrangement, the shielding conductor pattern shields the antenna from radio waves. When transmitting radio waves, no radio waves are emitted in the conductor pattern direction. The antenna is also shielded from electromagnetic noise from the conductor pattern direction.

A power feeding port may be formed on the surface of the outermost base so as to be exposed to the outside. A connecting section to be connected to another electronic component may be configured by the power feeding port and the shielding conductor pattern.

With such an arrangement, the parts to be connected with another electronic component, namely the power feeding port and the shielding conductor pattern, are coplanar. Hence, the antenna can be mounted on the electronic component at the coplanar surface.

A trimming pattern for trimming the impedance of the entire antenna may be formed on the bases.

With such a configuration, the impedance of the entire antenna can be changed to an arbitrary value by altering the shape of the trimming pattern in accordance with the necessary frequency.

The conducting sections may include through holes formed in the thickness direction of the bases.

With such an arrangement, in plan view, the conductor patterns are configured to be connected at a single point.

Preferably, the bases are protected by a covering while the shielding conductor pattern and the power feeding port are exposed to the outside.

According to the present invention, a small antenna is provided, which can be attached to the interior of a casing of each of various apparatuses, such as portable communication terminals, which have functions of transmitting and receiving radio waves. It is thus not necessary to extend the antenna, and hence the antenna is not easily damaged and the overall appearance is improved. The present invention is particularly advantageous when used in a frequency bands with a long wavelength, such as with the very high frequency (VHF) band and the ultra high frequency (UHF) band. By stacking a plurality of bases, a plurality of resonance modes are obtained by a plurality of capacitance components while the overall length remains the same.

According to the present invention, transmission of radio waves in the conductor pattern direction is blocked. Therefore, the antenna gains in the direction of areas in which the conductor patterns are absent are improved. It is thus possible to increase the transmission distance compared with a case in which no conductor pattern is used. At the same time, the antenna is shielded from noise from a radio transmitting and receiving circuit. It is thus possible to directly mount the antenna on a circuit board, allowing more freedom in choosing the mounting location. This is advantageous in that the antenna can be attached to the interior of a casing of each of the apparatuses having functions of transmitting and receiving radio waves.

According to the present invention, a connection section can be connected with solder to another electronic component, such as a printed board forming a radio transmitting and receiving circuit. This allows space saving when attaching the antenna to the interior of a casing of each of various apparatuses having functions of transmitting and receiving radio waves. The present invention is advantageous for trimming the impedance between a resonant system and a radio transmitting and receiving circuit system to be connected to the resonant system. When connecting a plurality of conductor patterns, no space is necessary. This is advantageous for the reduction of the outer dimensions. An exposed surface can be used as a mounting surface to be mounted on a transmission circuit board. Once the antenna is mounted, effects of oxidation of the conductor patterns and damage caused by external forces on radio transmission and reception are minimized.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
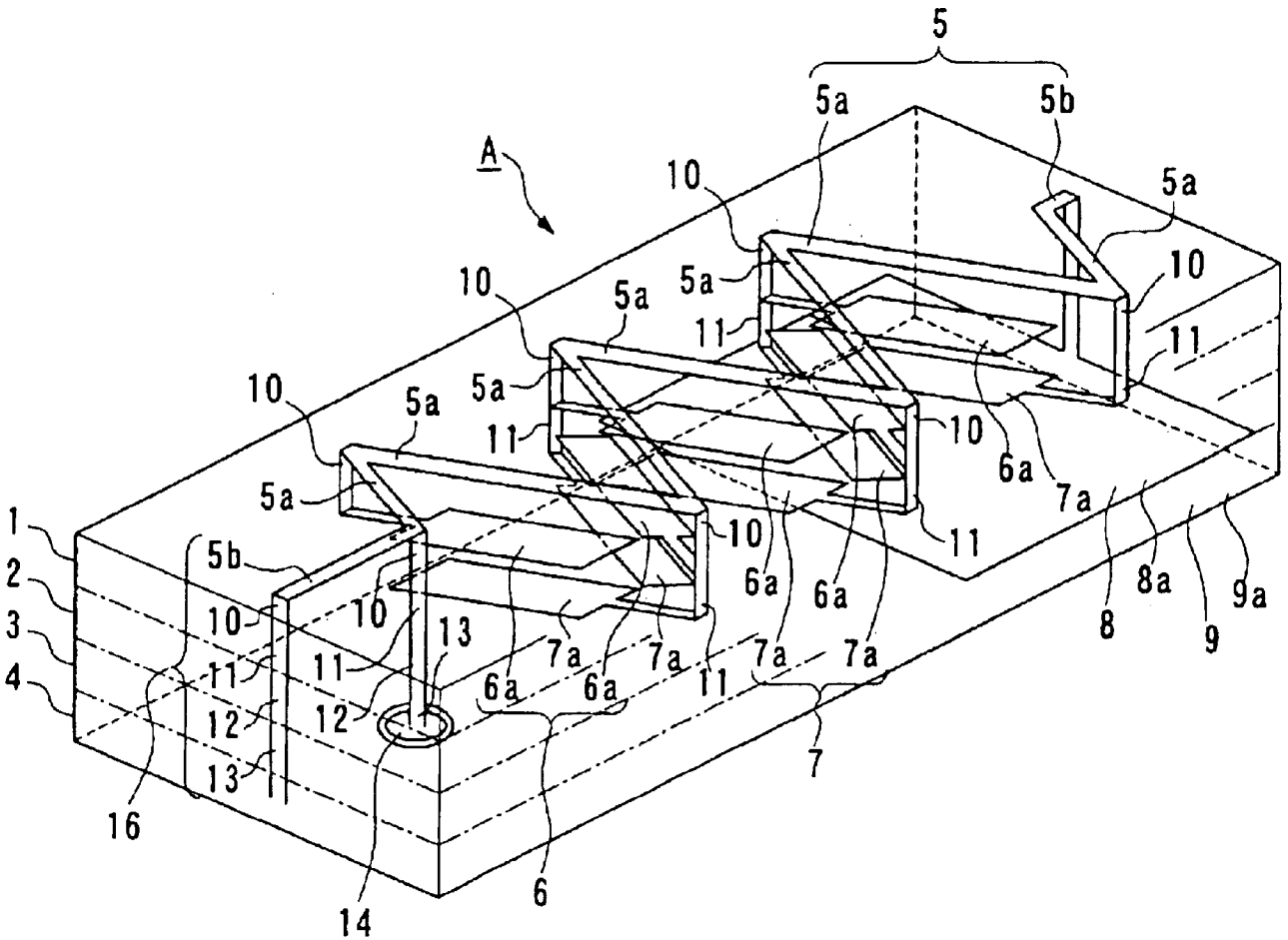
FIG. 1 is a perspective view of an antenna according to an embodiment of the present invention, part of the antenna being omitted.
Figure 2:
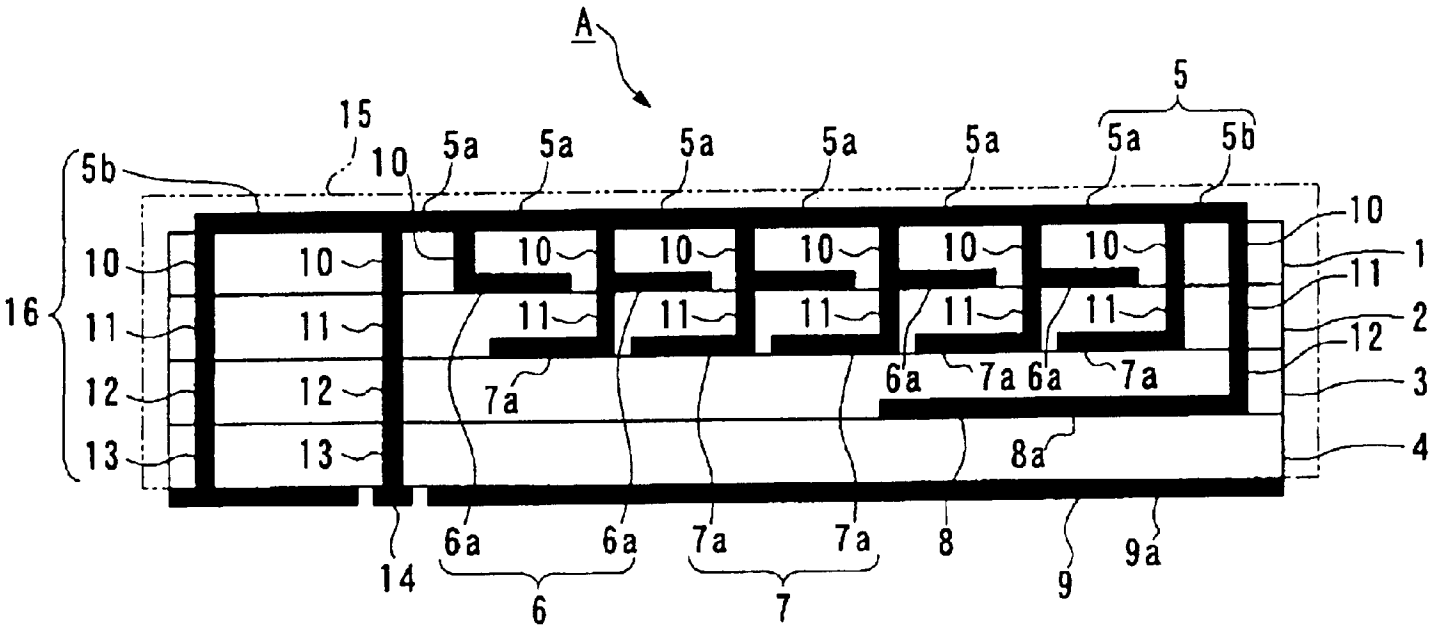
FIG. 2 is a front view of conducting sections illustrating positional relationships between conducting sections of the antenna of the present invention.

The present invention will be understood from the following description of the preferred embodiment taken in conjunction with the accompanying drawings, in which like reference numerals designate identical or corresponding elements throughout the figures. Referring to FIGS. 1 and 2, an antenna A includes a plurality of bases 1 to 4 stacked in the thickness direction. Conductor patterns 5 to 9 are formed on the bases 1 to 4, respectively, and conducting sections (through holes) 10 to 13 for electrically interconnecting the conductor patterns 5 to 9 are provided.

On surfaces of the bases 1 to 4, the conductor patterns can be formed of noble metals such as gold, silver, etc., by printing or the like. Subsequent to perforating the bases 1 to 4, the bases 1 to 4 are stacked one after another. The perforated holes are filled with conductive materials, and hence the through holes are formed. The bases 1 to 4 are baked and integrated.

The conductor patterns 5 to 9 include capacitance patterns 6*a* and 7*a*, which mainly contribute to forming capacitance components, and inductance patterns 5*a*, which mainly contribute to forming inductance components.

The conductor pattern 5 formed on the base 1 (first base) is formed of a zigzag conductor (inductance patterns 5*a*) arranged with a predetermined pitch. The conductor pattern 5 includes linear sections 5*b* at both ends thereof.

The conductor pattern 6 formed on the base 2 (second base) and the conductor pattern 7 formed on the base 3 (third base) are formed including the capacitance patterns 6*a* and 7*a*, which may be a plurality of rectangular patterns each having a linear section at one end. In plan view, these patterns 6*a* and 7*a* of the conductor patterns 6 and 7 are disposed so that one capacitance pattern is superposed on the other capacitance pattern.

The conductor pattern 8 includes a capacitance pattern 8*a*. The capacitance pattern 8*a* is formed as a single rectangular pattern on the base 4.

The conductor pattern 9 includes a pattern 9*a* serving both as a capacitance pattern and a shielding pattern. The conductor pattern 9 is formed as a connecting section to be connected to a printed board which forms a radio transmitting and receiving circuit. The conductor pattern 9 is formed on the outermost base 4 so as to be exposed to the outside. In this case, in plan view, the pattern 9*a* is disposed so as to overlap with the conductor patterns formed on the other bases.

The patterns 6*a* of the conductor pattern 6 and the patterns 7*a* of the conductor pattern 7 are connected to both ends of the patterns 5*a*.

The conductor pattern 8 is connected to one terminal of the conductor pattern 5 by the conducting sections 10 to 12.

The conductor pattern 9 is connected to the other terminal of the conductor pattern 5 by the conducting sections 10 to 13.

A power feeding port 14, which forms the connecting section to be connected to the printed board forming the radio transmitting and receiving circuit, is provided outside the outermost base 4. The power feeding port 14 is connected to the conductor pattern 5 through the conducting sections 10 to 13. In this configuration, the pattern 5*b* of the conductor pattern 5 and the conducting sections 10 to 13 form a trimming pattern 16.

Referring to FIG. 2, a protective covering 15 made of, e.g., synthetic resin is provided outside the entirety of the stacked bases 1 to 4 while the conductor pattern 9 and the power feeding port 14 are exposed to the outside.

According to the antenna, inductance components are formed by the patterns 5*a* of the conductor pattern 5, and capacitance components are formed between the conductor patterns 6 and 7. The inductance components and the capacitance components form parallel resonant circuits, which function as a resonant system required to transmit and receive radio waves. The parallel resonant circuits are connected in series, and the overall length thereof forms a radio transmitter and receiver, thereby constructing an array-type antenna. In this configuration, a predetermined resonant frequency is set based on the length of the patterns 5*a* of the conductor pattern 5, the inductance given by the linear sections of the conductor patterns 6 and 7 and the conducting sections 10 to 13, the areas of the patterns 6*a* and 7*a* of the conductor patterns 6 and 7, and the distance between the conductor patterns.

According to the antenna, the inductance components and the capacitance components formed by the conductor patterns 5 to 9 form the resonant system required to transmit and receive radio waves, which functions as an antenna.

The patterns 5*a* of the conductor pattern 5 can emit horizontal wave components in the diagonal direction of the zigzag sides and vertical wave components along the intersections of the zigzag sides. When the antenna is formed on the same plane at positions differing in the right-angle direction, radio waves of horizontally polarized waves and vertically polarized waves can be transmitted and received in a more satisfactory manner.

Since the pattern 9*a* of the conductor pattern 9 shields the antenna from radio waves, radio transmission in this direction is blocked. The antenna gains in the opposite direction are improved. Compared with a case in which no conductor pattern 9 is used, the transmission distance is increased. At the same time, the antenna is shielded from noise from the radio transmitting and receiving circuit. Accordingly, it is possible to directly mount the antenna on a circuit board and to allow freedom in selecting the mounting location. This is advantageous in that the antenna can be attached to the interior of a casing of each of various apparatuses having functions of transmitting and receiving radio waves.

The conductor pattern 9 and the power feeding port 14 are formed on the surface of the outermost base 4 to be exposed to the outside, and this section is regarded as the connecting section. Hence, it is possible to directly mount the antenna with solder on a printed board, which forms the radio transmitting and receiving circuit, at that surface. This allows space saving when attaching the antenna to the interior of a casing of each of various apparatuses having functions of transmitting and receiving radio waves.

The inductance components are formed by the linear section 5*b* of the conductor pattern 5, which extends from the position at which the power feeding port 14 is connected to the conductor pattern 5 to the terminal of the conductor pattern 5, and the conducting sections 10 to 13 toward the conductor pattern 9. Hence, the impedance of the entire antenna can be trimmed. It is thus possible to trim the impedance between the entire antenna and the radio transmitting and receiving circuit system to be connected to the antenna.

Since the conducting sections 10 to 13 are formed of the through holes formed in the thickness direction of the bases 1 to 4, no space is required when connecting a plurality of conductor patterns. This is advantageous in allowing for the reduction of the outer dimensions of the antenna. In this case, glass epoxy instead of ceramic can be used to form the bases 1 to 4. The holes may then be coated with conductor materials, and the through holes may then be formed. Alternatively, the through holes may be filled with a paste and baked. This is advantageous for reducing the impedance of the antenna.

Since the bases 1 to 4 are protected by the covering 15 while the conductor pattern 9 and the power feeding port 14 are exposed to the outside, the antenna can be mounted on a transmitting circuit board at the exposed surface, i.e., the mounting surface. Once the antenna is mounted, it is possible to minimize effects of oxidation of the conductor patterns and damage caused by external forces on radio transmission and reception.

Obviously, numerous modifications and variations of the present invention are possible in light of the above teachings. It is therefore to be understood that within the scope of the appended claims, the present invention may be practiced otherwise than as specifically described herein.

What is claimed is:

1. An antenna comprising:

a plurality of bases stacked in a thickness direction;

conductor patterns formed on the plurality of bases, respectively wherein at least one of the conductor patterns is formed in a zigzag pattern;

a conducting section configured to electrically interconnect the conductor patterns formed on the plurality of bases;

wherein the conductor patterns form at least one inductance component and at least one capacitance component; and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

2. An antenna according to claim 1, further comprising:

a power feeding port formed to be exposed outside the surface of the outermost base; and wherein the power feeding port and the shielding conductor pattern are used as a connecting section to be connected to another electronic component.

3. An antenna according to claim 1, further comprising a trimming pattern configured to trim an impedance of the antenna formed on the plurality of bases.

4. An antenna according to claim 2, further comprising a cover protecting the plurality of bases while the shielding conductor pattern and the power feeding port are exposed to the outside.

5. An antenna comprising:

a plurality of bases stacked in a thickness direction;

conductor patterns formed on the plurality of bases, respectively, wherein at least one of the conductor patterns is formed in a zigzag pattern;

a conducting section configured to electrically interconnect the conductor patterns formed on the plurality of bases; wherein the conductor patterns form at least one inductance component and at least one capacitance component;

wherein the at least one capacitance component is formed by, among the conductor patterns formed on the plurality of bases, a first conductor pattern formed on a first base of the plurality of bases and a second conductor pattern formed on a second base of the plurality of bases;

wherein at least one of the first and second conductor patterns forms the inductance component;

wherein the capacitance components and the inductance component are connected in parallel by the conducting section; and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

6. An antenna according to claim 5, further comprising:

a power feeding port formed to be exposed outside the surface of the outermost base; and wherein the power feeding port and the shielding conductor pattern are used as a connecting section to be connected to another electronic component.

7. An antenna according to claim 6, further comprising a cover protecting the plurality of bases while the shielding conductor pattern and the power feeding port are exposed to the outside.

8. An antenna comprising:

a plurality of bases stacked in a thickness direction;

conductor patterns formed on the plurality of bases, respectively wherein at least one of the conductor patterns is formed in a zigzag pattern;

a conducting section configured to electrically interconnect the conductor patterns formed on the plurality of bases;

wherein the conductor patterns form at least one inductance component and at least one capacitance component;

wherein a first inductance pattern is formed on a first base of the plurality of bases;

wherein a first capacitance pattern is formed on a second base of the plurality of bases adjoining the first base; and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

9. An antenna according to claim 8, further comprising:

a power feeding port formed to be exposed outside the surface of the outermost base; and wherein the power feeding port and the shielding conductor pattern are used as a connecting section to be connected to another electronic component.

10. An antenna according to claim 9, further comprising a cover protecting the plurality of bases while the shielding conductor pattern and the power feeding port are exposed to the outside.

11. An antenna comprising:

a plurality of bases stacked in a thickness direction;

conductor patterns formed on the plurality of bases, respectively; and a conducting section configured to electrically interconnect the conductor patterns formed on the plurality of bases;

wherein the conductor patterns form at least one inductance component and at least one capacitance component;

wherein the at least one inductance component and the at last one capacitance component form respective parallel resonant circuits, connected in series; and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

12. An antenna according to claim 11, further comprising:

a power feeding port formed to be exposed outside the surface of the outermost base; and wherein the power feeding port and the shielding conductor pattern are used as a connecting section to be connected to another electronic component.

13. An antenna according to claim 11, further comprising a trimming pattern configured to trim an impedance of the antenna formed on the plurality of bases.

14. An antenna according to claim 12, further comprising a cover protecting the plurality of bases while the shielding conductor pattern and the power feeding port are exposed to the outside.

15. An antenna comprising:

a plurality of bases stacked in a thickness direction;

conductor patterns formed on the plurality of bases, respectively;

a conducting section configured to electrically interconnect the conductor patterns formed on the plurality of bases;

wherein the conductor patterns form at least one inductance component and at least one capacitance component;

wherein the at least one inductance component and the at last one capacitance component form respective parallel resonant circuits, connected in series;

wherein the at least one capacitance component is formed by, among the conductor patterns formed on the plurality of bases, a first conductor pattern formed on a first base of the plurality of bases and a second conductor pattern formed on a second base of the plurality of bases;

wherein at least one of the first and second conductor patterns forms the inductance component;

wherein the capacitance component and the inductance component are connected in parallel by the conducting session; and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

16. An antenna according to claim 15, further comprising:

a power feeding port formed to be exposed outside the surface of the outermost base; and wherein the power feeding port and the shielding conductor pattern are used as a connecting section to be connected to another electronic component.

17. An antenna according to claim 16, further comprising a cover protecting the plurality of bases while the shielding conductor pattern and the power feeding port are exposed on the outside.

18. An antenna comprising:

a plurality of bases stacked in a thickness direction;

conductor patterns formed on the plurality of bases, respectively;

a conducting section configured to electrically interconnect the conductor patterns formed on the plurality of bases;

wherein the conductor patterns form at least one inductance component and at least one capacitance component;

wherein the at least one inductance component and the at last one capacitance component form respective parallel resonant circuits, connected in series;

wherein a first inductance pattern is formed on a first base of the plurality of bases;

wherein a first capacitance pattern is formed on a second base of the plurality of bases adjoining the first base;

wherein a second capacitance pattern, which is opposed to the first capacitance pattern to form said at least one capacitance component, is formed on a third base of the plurality of bases adjoining the second base;

wherein the first inductance pattern and the at least one capacitance component formed by the first and second capacitance patterns are connected in parallel by the conducting section and further comprising:

a shielding conductor pattern formed on a surface of an outermost base of the plurality of bases, the shielding conductor pattern being exposed to the outside, and in plan view, the shielding conductor pattern being superimposed on the conductor patterns formed on other bases of the plurality of bases.

19. An antenna according to claim 18, further comprising:

a power feeding port formed to be exposed outside the surface of the outermost base; and wherein the power feeding port and the shielding conductor pattern are used as a connecting section to be connected to another electronic component.

20. An antenna according to claim 19, further comprising a cover protecting the plurality of bases while the shielding conductor pattern and the power feeding port are exposed to the outside.

21. An antenna comprising:

a plurality of base means stacked in a thickness direction;

conductor means for conducting formed on the plurality of base means;

interconnecting means for electrically interconnecting the conductor means formed on the plurality of base means;

wherein the conductor means forms at least one inductance means and at least one capacitance means;

wherein the at least one inductance means and the at least one capacitance means form respective parallel resonant circuit means, connected in a series; and further comprising:

shielding means for shielding the plurality of base means.

22. An antenna according to claim 21, further comprising:

power feeding means for connecting to another electronic component.

23. An antenna according to claim 22, further comprising trimming means for trimming an impedance of the antenna formed on the plurality of base means.

24. An antenna according to claim 23, further comprising covering means for protecting the plurality of base means.

* * * * *